United States Patent [19]

Goad

[11] 4,363,144

[45] Dec. 14, 1982

[54] PROSTHETIC DEVICE FOR MASTECTOMY PATIENTS

[76] Inventor: Helen G. Goad, 9459 Mission Gorge Rd. #124, Santee, Calif. 92071

[21] Appl. No.: 200,204

[22] Filed: Oct. 24, 1980

[51] Int. Cl.[3] ..... A41C 3/08

[52] U.S. Cl. ..... 3/36; 128/453

[58] Field of Search ..... 3/36; 128/455, 452, 128/456, 453, 457, 458, 478, 488, 494, 506, 512

[56] References Cited

U.S. PATENT DOCUMENTS

| | | | |
|---|---|---|---|
| 75,031 | 3/1868 | Libbey | 3/36 X |
| 2,066,503 | 1/1937 | Wiggers | 3/36 |
| 2,435,860 | 2/1948 | Wilkenfeld et al. | 3/36 X |
| 2,875,449 | 3/1959 | Morris | 3/36 |
| 3,179,109 | 4/1965 | Born | 3/36 |
| 3,212,503 | 11/1965 | Gorman | 128/456 |
| 3,311,112 | 3/1967 | Murray | 128/512 |
| 3,348,241 | 10/1967 | Dodds | 3/36 |
| 3,576,037 | 4/1971 | Klein | 3/36 |
| 4,227,536 | 3/1979 | Shimenkou et al. | 3/36 X |

*Primary Examiner*—Richard J. Apley
*Assistant Examiner*—David J. Isabelle
*Attorney, Agent, or Firm*—Charmasson, Branscomb & Holz

[57] ABSTRACT

A prosthetic device for mastectomy patients is provided wherein a brassiere is modified by the incorporation of temporary fasteners in at least one cup which will hold in place a prosthetic pad of unique manufacture. The brassiere itself is preferably releasably retained by fasteners mounted to the frontal top portions of a slip.

1 Claim, 6 Drawing Figures

PROSTHETIC DEVICE FOR MASTECTOMY PATIENTS

BACKGROUND

Most brassieres are maintained in place at least partially by straps which pass posterially of the upper torso and cinch the brassiere cups firmly against the chest. This cinching action, in order to be effective, is of sufficient force that the strap passing along the bottom of the brassiere presses into the flesh, and in the instance of mastectomy patients who have sensitive scar tissue in many instances which pass across the lower band of the brassiere, the chafing of this band can become quite a problem.

As the band chafes, the wearer is tempted to unhook the brassiere, which in itself present a difficulty inasmuch as much of the muscle tissue is removed during a radical mastectomy, making it difficult for the wearer to get both hands behind the back to the position where most bras are fastened. An additional difficulty is that the prosthetic insert pad is conventionally a silicone device designed to be approximately the same density as a natural breast, and loosening the bottom strap of the bra will sometimes cause the pad to fall out.

Therefore, there is a deficiency in the art of prosthetic devices for mastectomy patients inasmuch as there is needed a pad which is easily and comfortably held in place by other than the cinching force of a hand or strap passing posterially of the patient.

SUMMARY

The present prosthetic garment fulfills the above-stated need by providing a brassiere having releasable fasteners such as snaps defined on the interior of at least one cup, to which a prosthetic pad is releasably engaged. The bra itself is provided with fasteners adjacent to the top, which cooperate with fasteners on the top frontal portion of a slip, so that the slip supports the weight of the bra and appurtenant structure. An adjustable retaining strap is releasably engaged at both ends to the bottom band of the bra to provide easy left or right-handed operation, and this band is designed to provide only a very gentle cinching action, because the weight of the bra and its appurtenant structure is supported principally by the slip.

The prosthetic pad is provided in a unique construction which very simply incorporates light padding material overlaid with a resilient, foam contoured cover, all of which is encapsulated in a flexible cloth wrapper which is bunched together in the front and tied to present a protuberance somewhat nipple-like in appearance, at least through clothing. The pad is snapped or otherwise removably fastened to the fasteners on the interior of the bra cup.

DETAILED DESCRIPTION

Figure 1:
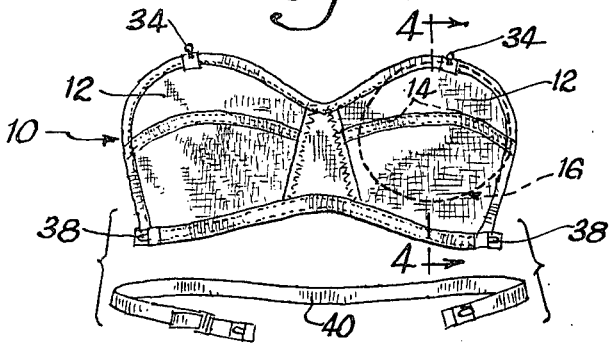
FIG. 1 is a front elevation view of the brassiere showing the strap below.

The brassiere of the instant invention comprises a body portion 10 having two cups 12, one or both of which are provided with internally directed fasteners such as snaps 14. The prosthetic pad 16 is releasably engaged inside the cup by means of snaps 18 so that it can be removed for washing and replacement. Each of the cups 12 could be provided with snaps so that the bra would be universally applicable, or as in the illustration, two separate bras would be provided for left and right application.

Figure 4:
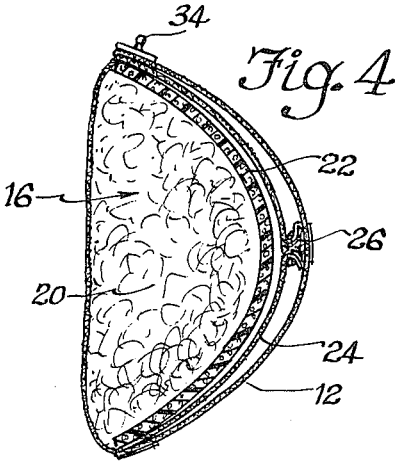
FIG. 4 is a section taken through the prosthetic pad.
Figure 5:
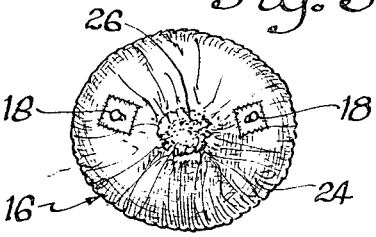
FIG. 5 is a top elevation view of the prosthetic pad removed from the brassiere.

The construction of the brassiere itself incorporates a generally dome-shaped padding 20 of a lightweight material such as cotton or other fibrous material. Covering this material is a resilient, form-retaining cover 22 made of a lightweight foam or the like which establishes the contour of the pad as is best seen in FIG. 4. The padding and cover are together encapsulated in a cloth wrapper 24 which is bunched together at 26 and bound with a thread or the like to define a cloth tuft which, when used with the bra and slip of the present invention, gives the external appearance of conforming to female anatomy. In order to maintain these parts of the prosthetic pad in position, the wrapper is stitched to the edge of the cover as in 28. This stitching, together with the loop around the tuft 26 effectively secures all parts of the prosthetic pad in place.

Figure 2:
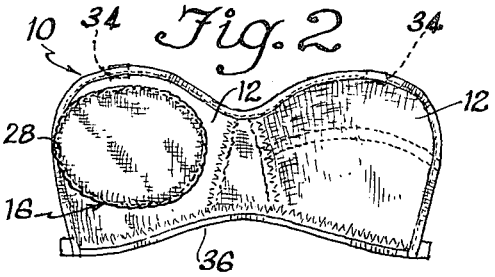
FIG. 2 is a rear elevation view of the brassiere showing the prosthetic pad in place.
Figure 3:
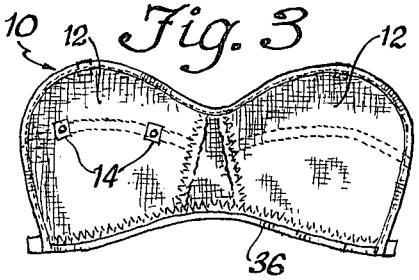
FIG. 3 is a view identical to FIG. 2 with the prosthetic pad removed.
Figure 6:
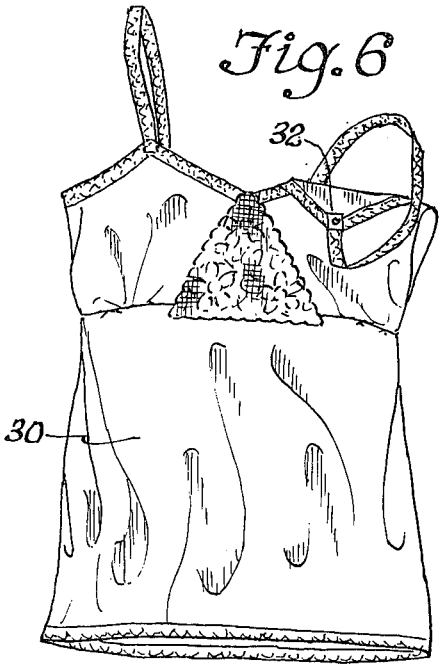
FIG. 6 is a front elevation view of a slip modified to temporarily, releasably engage the top portion of the brassiere to support same comfortably beneath outer clothing.

Once the pad is snapped into the cup of the bra 10, there remains the task of supporting the bra and holding it to the body. As indicated in FIG. 6, a special slip 30 is provided having snaps 32 or other suitable fasteners disposed in the inside of the top frontal portion of the slip. These snaps cooperate with the snaps 34 shown in FIGS. 1, 2 and 4, which are stitched into the upper edge of the bra cups so that the slip, when worn in normal fashion, supports the entire weight of the bra, together with its snapped into place prosthetic pad 16.

The bottom portion of the bra body 10 has a continuous band 36, the ends of which define fasteners 38 which releasably attach to the end of an adjustable strap 40. This strap, being a simple hook and eyelet as shown or other detachable connector means, permits the user to selectively attach and detach the strap from the body at either side, an important feature if one arm is left substantially weakened and debilitated from surgery.

Because the slip bears the weight of the bra and prosthetic pad, the strap 40 need only be lightly fastened, avoiding the problem of continuous chafing of the sensitized body portions by the lower band 36 of the bra.

As thus described and claimed, a prosthetic device is provided which is convenient and lightweight, and which eliminates two major problems associated with post-mastectomy living, one being the chafing irritation of the bra against sensitized scar tissue, and the other being the problem of maintaining the prosthetic in position if the bra were loosened to ease the above-mentioned chafing.

What is claimed is:

1. A prosthetic device comprising:

(a) a brassiere with two cups having fastening means on the interior of at least one of the cups;

(b) a prosthetic pad having first releasable attachment means for removably attaching same to said fastening means, whereby said prosthetic pad is selectably wearable in said brassiere or removable from said brassiere for washing or replacement;

(c) said prosthetic pad being constructed of interior padding having a resilient form-retaining contoured front cover and a flexible cloth wrapper encapsulating said padding and front cover and said flexible wrapper has a frontal edge and is bunched and stitched together just short of said frontal edge to secure said padding and cover in place and so that the frontal edge itself is free to expand outwardly into a tuft to simulate a nipple;

(d) a slip having a second fastener means proximate the upper frontal portion thereof and wherein the top portion of said brassiere has second releasable attachment means releasably engageable by said second fastener means to support said brassiere, whereby the principal support for said brassiere is provided independently of body-encircling straps; and (e) said brassiere having bottom edges and the sole rear support for said brassiere being a strap for fastening same to the body of the user, said strap being connected to the bottom edges of said brassiere and passing posteriorly of the wearer and being releasable from said brassiere from either end to permit single-handed right or left handed operation.

* * * * *